US006953177B2

(12) United States Patent
Holland

(10) Patent No.: US 6,953,177 B2
(45) Date of Patent: Oct. 11, 2005

(54) ARTICLE SUPPORT APPARATUS WITH MOVABLE DISPLAY PANEL

(75) Inventor: Jason S. Holland, Raleigh, NC (US)

(73) Assignee: Adstracts, Inc., Raleigh, NC (US)

( * ) Notice: Subject to any disclaimer, the term of this patent is extended or adjusted under 35 U.S.C. 154(b) by 17 days.

(21) Appl. No.: 10/881,311

(22) Filed: Jun. 30, 2004

(65) Prior Publication Data

US 2004/0232300 A1 Nov. 25, 2004

Related U.S. Application Data

(63) Continuation of application No. 10/252,325, filed on Sep. 23, 2002, now Pat. No. 6,789,773.

(51) Int. Cl.[7] ..... F16B 45/00
(52) U.S. Cl. ..... 248/307; 40/491
(58) Field of Search ..... 248/307, 205.3; 40/490, 491, 488; 116/321, 323, 324

(56) References Cited

U.S. PATENT DOCUMENTS

| | | | | | |
|---|---|---|---|---|---|
| 790,190 | A | * | 5/1905 | Cooper | 40/322 |
| 1,052,981 | A | * | 2/1913 | Strobel | 232/34 |
| 1,077,416 | A | * | 11/1913 | Maxwell | 40/491 |
| 1,100,802 | A | * | 6/1914 | Wesolowski | 81/3.32 |
| 2,193,699 | A | * | 3/1940 | Sadler | 248/307 |
| 3,978,601 | A | * | 9/1976 | Catron | 40/322 |
| 4,217,713 | A | * | 8/1980 | Greenberger | 40/488 |
| D260,480 | S | | 9/1981 | DeMars | D8/367 |
| D300,089 | S | | 3/1989 | Edwards | D6/323 |
| D301,406 | S | | 6/1989 | Barbieri et al. | D6/323 |
| D301,407 | S | | 6/1989 | Boeri | D6/323 |
| D301,523 | S | | 6/1989 | Barbieri et al. | D6/323 |
| D301,807 | S | | 6/1989 | Friedman | D6/323 |
| D307,522 | S | | 5/1990 | Bellini | D6/323 |
| 5,411,233 | A | | 5/1995 | Grimes, III et al. | 248/305 |
| 5,507,423 | A | | 4/1996 | Fischer et al. | 224/313 |
| 5,560,575 | A | | 10/1996 | Krysiak | 248/222.12 |
| 5,608,979 | A | * | 3/1997 | Johnson | 40/491 |
| D390,014 | S | | 2/1998 | Ho | D6/323 |
| D403,998 | S | | 1/1999 | Hutzel et al. | D12/190 |
| 5,967,344 | A | | 10/1999 | Liberati | 211/87.01 |
| 6,065,657 | A | | 5/2000 | Fischer | 224/313 |
| 6,095,469 | A | | 8/2000 | Von Alman | 248/304 |
| 6,237,265 | B1 | * | 5/2001 | Crowell | 40/491 |
| 6,397,435 | B1 | | 6/2002 | Gosselet | 16/438 |

* cited by examiner

*Primary Examiner*—Korie Chan
(74) *Attorney, Agent, or Firm*—Myers Bigel Sibley & Sajovek

(57) ABSTRACT

Apparatus are provided that may be used, for example, by healthcare providers to educate patients and others on one or more particular pharmaceutical products. A promotional apparatus includes a housing, a support member that is configured to support articles suspended therefrom, and a display panel. The support member extends from the housing and is movable between a first position when not supporting an article and a second position when supporting an article. The display panel is operably coupled with the support member and is movable between a retracted, non-visible position within the housing when the support member is in the first position and an extended, visible position when the support member is in the second position. The display panel includes promotional indicia thereon.

6 Claims, 8 Drawing Sheets

ARTICLE SUPPORT APPARATUS WITH MOVABLE DISPLAY PANEL

RELATED APPLICATION

This application is a continuation application of U.S. patent application Ser. No. 10/252,325, filed Sep. 23, 2002, now U.S. Pat. No. 6,789,773, which is incorporated herein by reference in its entirety.

FIELD OF THE INVENTION

The present invention relates generally to product promotion and, more particularly, to the promotion of healthcare-related products.

BACKGROUND OF THE INVENTION

The use of promotional items has proliferated in today's increasingly competitive marketplace, where companies are constantly seeking more effective and new ways to market their products. In the healthcare industry, physicians and other healthcare providers often receive promotional articles from vendors of healthcare-related products, such as pharmaceutical products. These promotional articles often include "everyday" items, such as writing pads, calendars, and pens that have promotional information (indicia) printed thereon. For example, pharmaceutical companies often provide physicians with writing pens having the name of a particular pharmaceutical product printed thereon with the hopes that the pens, when used by the physicians, will help remind the physicians to prescribe the particular pharmaceutical product.

Unfortunately, because of lack of distinctiveness, many promotional articles provided to healthcare providers often become "lost-in-the-shuffle" with other promotional articles. Thus, there is a need for distinctive, more effective promotional products directed to physicians and other healthcare providers.

SUMMARY OF THE INVENTION

In view of the above discussion, promotional apparatus are provided that may be used, for example, by healthcare providers to educate patients and others on one or more particular pharmaceutical products. According to embodiments of the present invention, a promotional apparatus includes a housing, a support member that is configured to support articles suspended therefrom, and a display panel. The support member extends from the housing and is movable between a first position when not supporting an article (e.g., clothing, medical instruments, etc.) and a second position when supporting an article. The display panel is operably coupled with the support member and is movable between a retracted, non-visible position within the housing when the support member is in the first position and an extended, visible position when the support member is in the second position. The display panel includes promotional indicia thereon.

According to embodiments of the present invention, the support member is movable between first and second positions in a first direction, and the display panel is movable between retracted and extended positions in a second direction that is substantially parallel with the first direction.

According to other embodiments of the present invention, the support member is movable between first and second positions in a first direction, and the display panel is movable between retracted and extended positions in a third direction that is substantially transverse to the first direction.

According to other embodiments of the present invention, the display panel may remain visible until an article is placed on the support member. The display panel is configured to retract from view when an article is placed on the support member.

BRIEF DESCRIPTION OF THE DRAWINGS

The accompanying drawings, which form a part of the specification, illustrate key embodiments of the present invention. The drawings and description together serve to fully explain the invention.

DETAILED DESCRIPTION OF THE INVENTION

Figure 1:
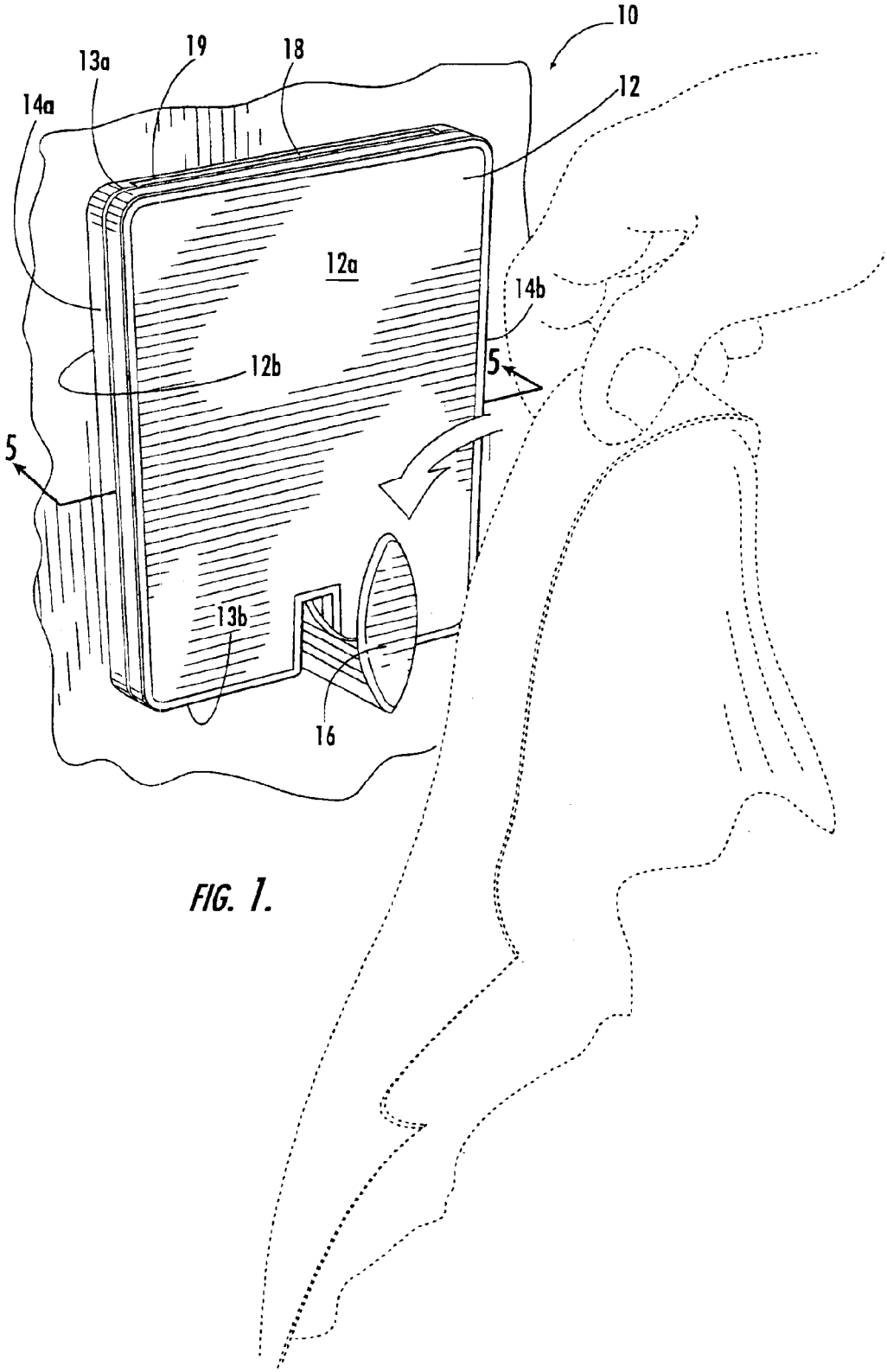
FIG. 1 is a perspective view of an apparatus, according to embodiments of the present invention, having a support member extending therefrom that is configured to support an article placed thereon and that is operably connected with a display panel.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the thickness of lines, layers and regions may be exaggerated for clarity. It will be understood that when an element is referred to as being "on" another element, it can be directly on the other element or intervening elements may also be present. In contrast, when an element is referred to as being "directly on" another element, there are no intervening elements present. It will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present.

Figure 2:
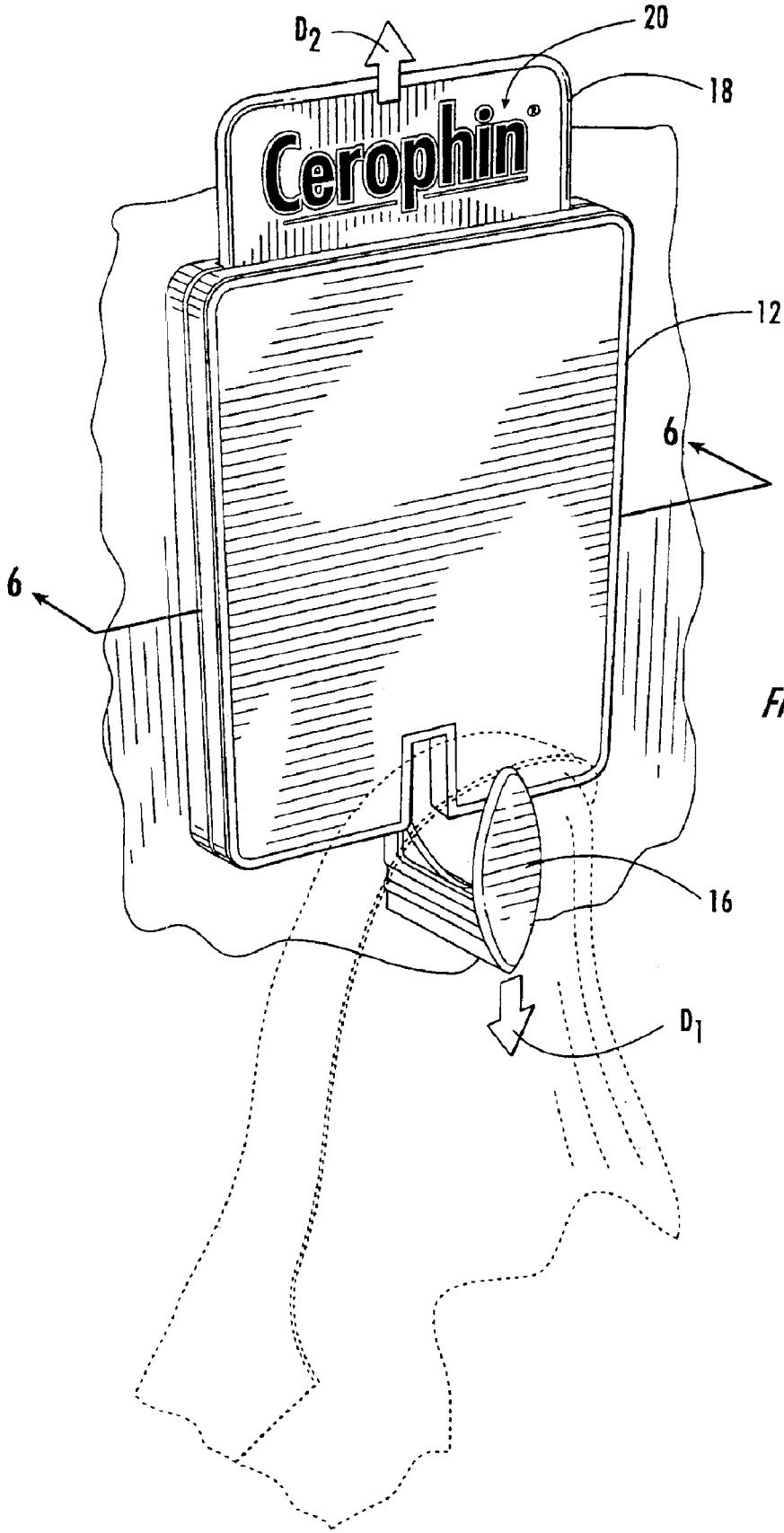
FIG. 2 is a perspective view of the apparatus of FIG. 1, wherein the display panel has been extended to a generally vertical display position in response to an article being placed on the support member.

Referring now to FIGS. 1–2, a promotional apparatus 10 according to embodiments of the present invention is illustrated. The illustrated promotional apparatus 10 may be used, for example, by healthcare providers to educate patients and others on one or more particular pharmaceutical products. The illustrated promotional apparatus 10 may also be used in various other industries to promote various goods and/or services.

The illustrated promotional apparatus 10 includes a housing 12, a support member 16 that is configured to support articles suspended therefrom, and a display panel 18. The illustrated housing 12 has a generally rectangular configuration with opposite front and rear sides 12*a*, 12*b*, opposite end portions 13*a*, 13*b*, and opposite edge portions 14*a*, 14*b*.

Figure 4:
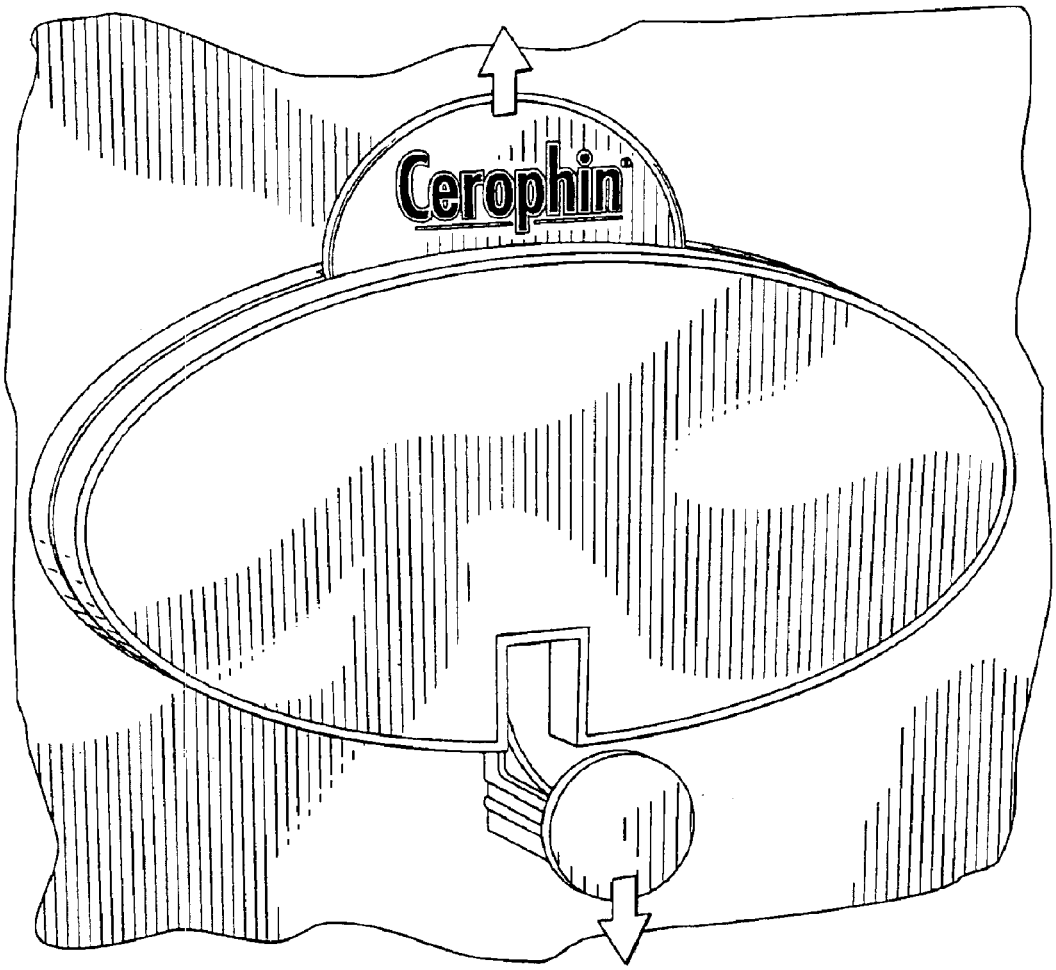
FIG. 4 is a perspective view of an apparatus, according to embodiments of the present invention, having a support member extending therefrom that is configured to support an article placed thereon and that is operably connected with a display panel.

The housing 12 may be formed from various materials including, but not limited to, polymeric materials, wood, metals, glass, etc. In addition, a promotional apparatus according to embodiments of the present invention may have a housing with various shapes including, but not limited to rectangular (FIGS. 1–2), round or oval (FIG. 4), triangular, or any geometric shape. Embodiments of the present invention are not limited to the illustrated housing shape, or to a particular type of material. Housings having various shapes, configurations, and materials may be utilized without limitation. In addition, the housing 12 may include promotional indicia in one or more locations.

The support member 16 extends from housing end portion 13*b*, as illustrated, and is movable between a first position when not supporting an article (FIG. 1) and a second position when supporting an article (FIG. 2). The illustrated support member 16 is configured to support an article of clothing placed thereon. According to embodiments of the present invention, a support member may be configured to support medical instruments (e.g., stethoscopes, FIG. 7) and/or various other articles. In addition, a support member according to embodiments of the present invention may have various shapes, sizes and configurations and may be formed from various types of materials, without limitation.

The display panel 18 is operably coupled with the support member 16 and is movable between a retracted, non-visible position within the housing 12 (FIG. 1) when the support member is in the first position and an extended, visible position when the support member is in the second position (FIG. 2). In the illustrated embodiment, the display panel 18 extends from the housing 12 via a slot 19 formed in housing end 13*a*.

Figure 7:
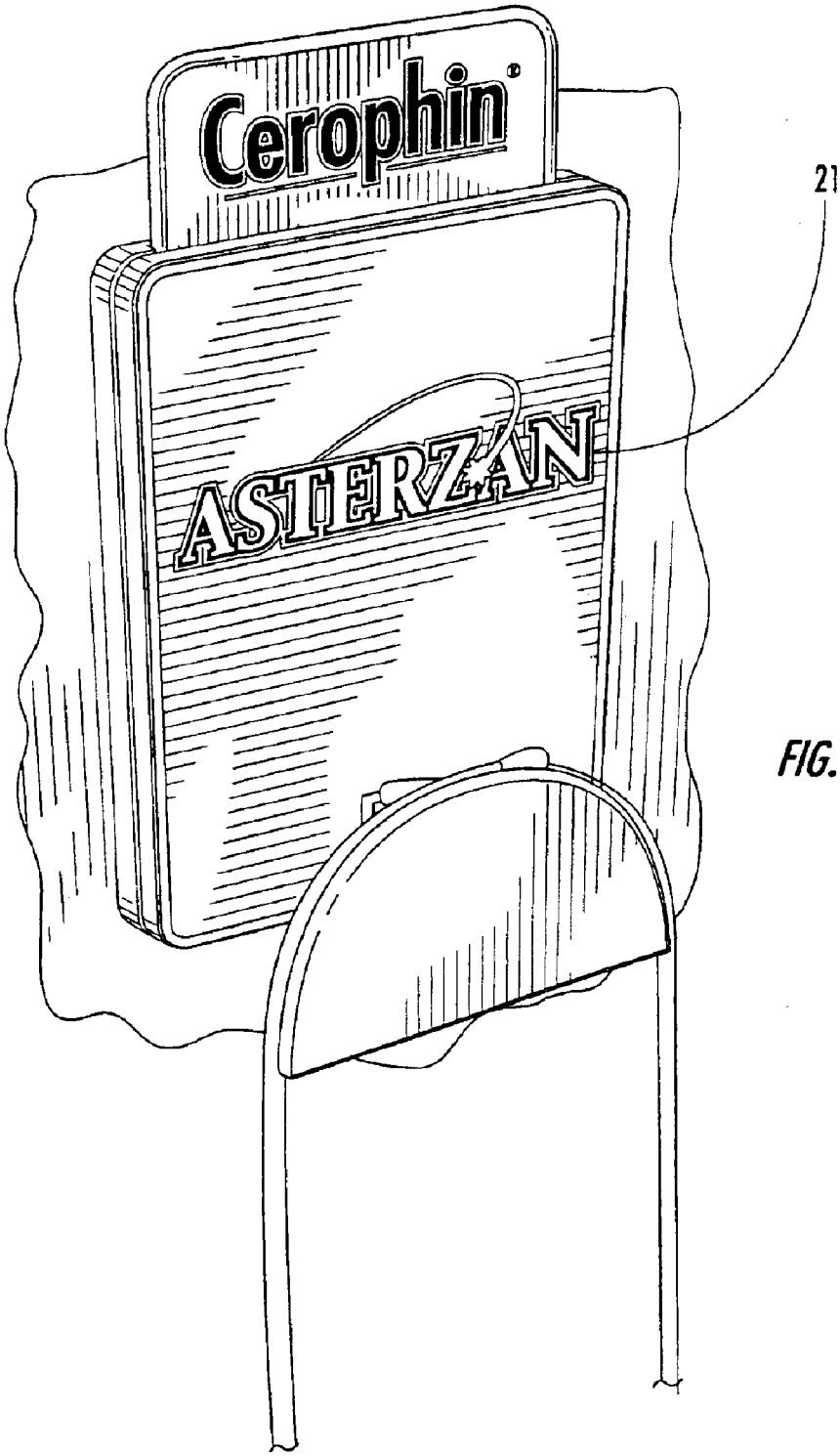
FIG. 7 is a perspective view of an apparatus, according to embodiments of the present invention, having a support member extending therefrom that is configured to support a stethoscope or other medical devices placed thereon and that is operably connected with a display panel.

The display panel includes promotional indicia 20 thereon, as illustrated in FIG. 2. According to embodiments of the present invention, the housing 12 may include promotional indicia 21 in one or more locations, as illustrated in FIG. 7. In addition, a display panel according to embodiments of the present invention may have various shapes, sizes and configurations and may be formed from various types of materials, without limitation.

Figure 3:
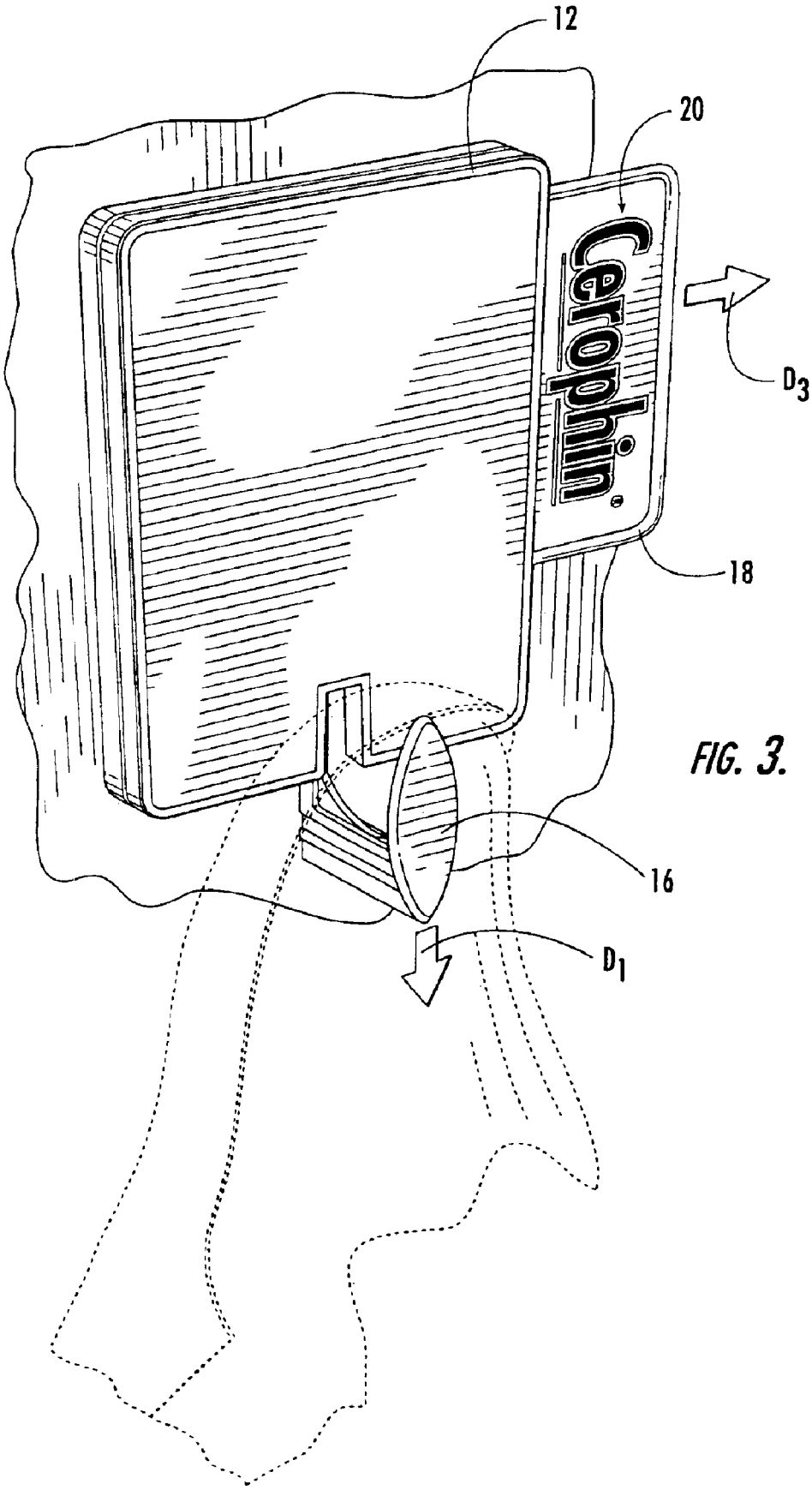
FIG. 3 is a perspective view of an apparatus, according to embodiments of the present invention, having a support member extending therefrom that is configured to support an article placed thereon and that is operably connected with a display panel that extends in a generally horizontal direction.

In the embodiment of FIG. 2, the support member 16 is movable between first and second positions in a first direction $D_1$, and the display panel 18 is movable between retracted and extended positions in a second direction $D_2$ that is substantially parallel with the first direction $D_1$. In the embodiment of FIG. 3, the support member 16 is movable between first and second positions in a first direction $D_1$, and the display panel 18 is movable between retracted and extended positions in a third direction $D_3$ that is substantially transverse to the first direction $D_1$.

Figure 5:
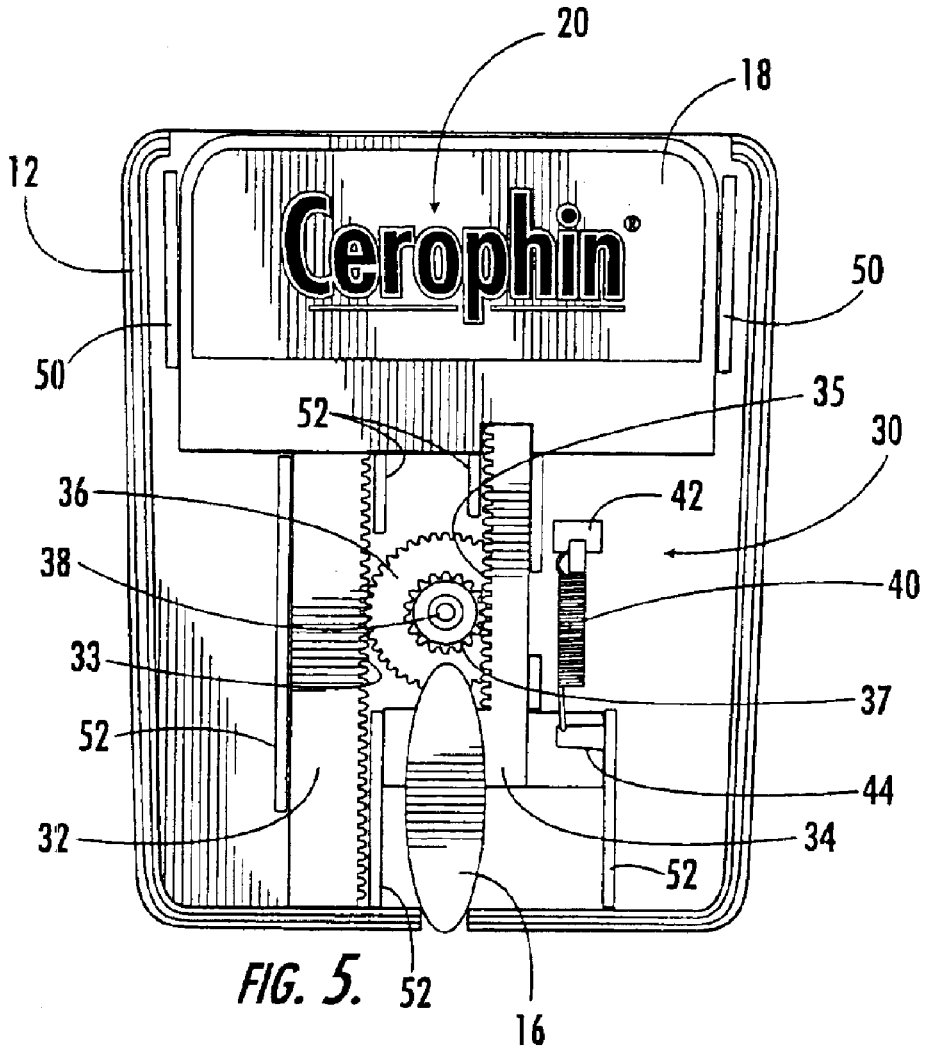
FIG. 5 is cross-sectional view of the apparatus of FIG. 1 taken along lines 5—5 and illustrating the display panel in a retracted position.
Figure 6:
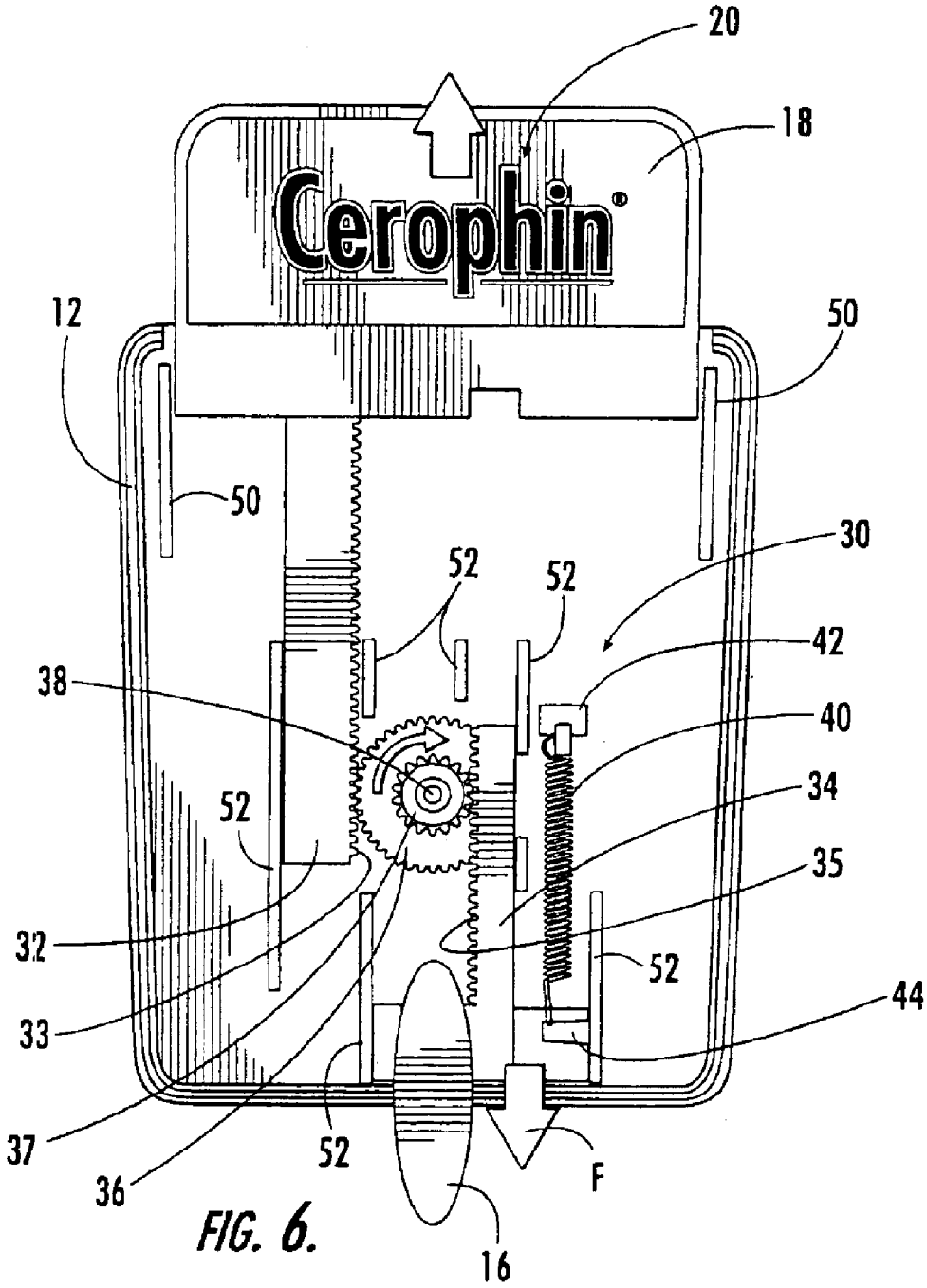
FIG. 6 is cross-sectional view of the promotional apparatus of FIG. 2 taken along lines 6—6 and illustrating the display panel in an extended position as a result of a downward force on the support member.

Referring to FIGS. 5–6, an exemplary mechanism 30 for operably coupling the display panel 18 and the support member 16 is illustrated. The illustrated mechanism 30 is a rack and pinion-type mechanism; however, it is understood that various other mechanisms may be utilized for operably coupling the display panel 18 and the support member 16. A rack 32 having a plurality of spaced-apart teeth 33 is connected to the display panel 18, as illustrated. A rack 34 having a plurality of spaced-apart teeth 35 is connected to the support member 16, as illustrated. The respective racks 32, 34 are operably coupled via a pair of respective pinion gears 36, 37 that are secured to shaft 38. Pinion gear 36 matingly engages the teeth 33 of rack 32, and pinion gear 37 matingly engages the teeth 35 of rack 34. Accordingly, movement of support member 16 causes rotation of pinion gear 37 which causes rotation of pinion gear 36 which causes movement of the display panel 18.

In FIG. 6, a downward force F has been imparted on the support member 16 (e.g., by the placement of an article, such as an article of clothing, on the support member). The downward force F moves the support member 16 downwardly, thereby moving the rack 34 downwardly which causes the pinion gears 36, 37 to rotate in a clockwise direction as indicated. Clockwise movement of pinion gear 37 causes the rack 32 to move upwardly, thereby causing the display panel 18 to extend from the housing 12.

The illustrated mechanism 30 includes a spring 40 configured to cause the display panel 18 to return to the retracted position when an article is no longer supported by the support member 16. The illustrated spring 40 has one end secured to a housing member 42 and the opposite end secured to a portion 44 of rack 34. Thus, downward movement of the support member 16 causes the spring 40 to elongate as illustrated in FIG. 6, thereby providing a spring force for urging the support member 16 back to a first position when an article placed thereon is removed.

In the illustrated embodiment, guide members 50 are formed within the housing 12 for guiding the display panel 18 between retracted and extended positions. Guide members 52 are also formed within the housing 12 for guiding the racks 32, 34 between operating positions.

Figure 8:
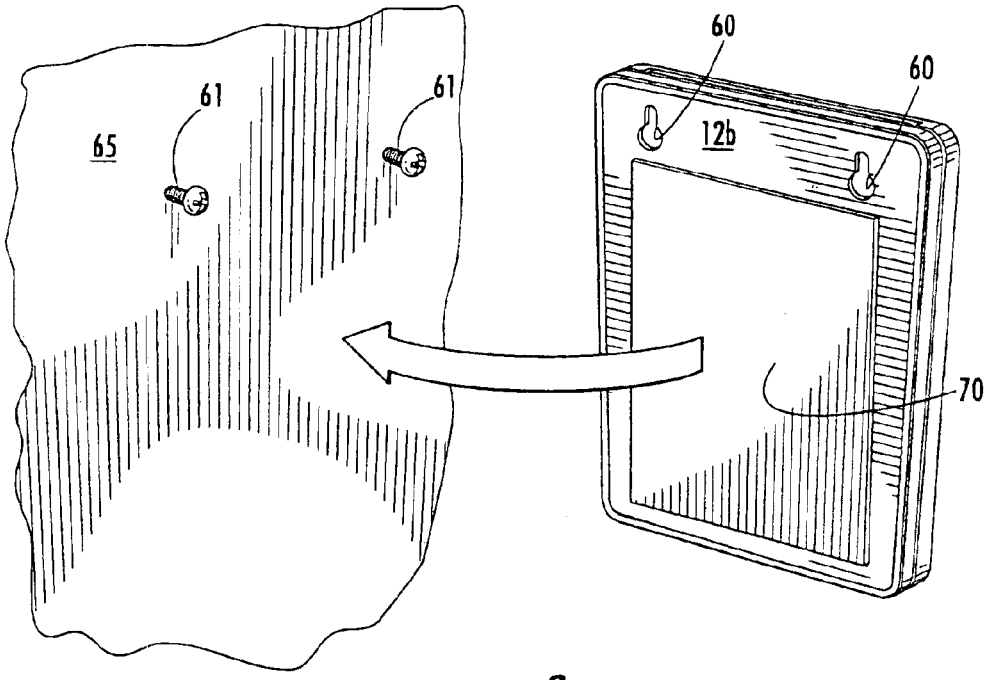
FIG. 8 is a rear plan view of the apparatus of FIG. 1.

Referring to FIG. 8, the housing 12 may include one or more apertures 60 formed therein (e.g., in the housing rear side 12*b*) that are configured to support the promotional apparatus 10 on respective supporting members 61 (e.g., screws, nails, hooks, etc.) extending from a surface 65, such as a wall. According to other embodiments of the present invention, an adhesive 70 may be applied to the rear side 12*b* of the housing 12 that is configured to secure the promotional apparatus 10 to a surface 65, such as a wall. According to embodiments of the present invention, a magnet (which may also be indicated by 70) may be attached to the rear side 12*b* of the housing 12 and configured to removably secure the promotional apparatus 10 to a magnetically attractive surface.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An apparatus, comprising:

a housing;

a support member extending from the housing that is configured to support articles suspended therefrom, wherein the support member is reciprocally movable between a first position when not supporting an article and a second position when supporting an article;

a display panel operably coupled with the support member and reciprocally movable between a retracted, non-visible position when the support member is in the first position and an extended, visible position when the support member is in the second position, wherein the display panel comprises promotional indicia thereon;

wherein the support member is movable from the first position when not supporting an article to the second position when supporting an article along a first direction, and wherein the display panel is movable from the retracted position to the extended position along a second direction that is substantially opposite to the first direction; and a spring that urges the display panel to the retracted, non-visible position when the support member is not supporting an article.

2. The apparatus of claim 1, wherein the display panel is disposed within the housing and is movable between the retracted and extended positions via an opening in the housing, wherein the display panel is disposed within the housing when in the retracted position, and wherein the display panel extends from the housing when in the extended position.

3. The apparatus of claim 1, wherein the first and second directions are substantially parallel.

4. The apparatus of claim 1, wherein the housing comprises promotional indicia thereon.

5. The apparatus of claim 1, wherein the housing comprises at least one aperture formed therein that is configured to support the apparatus on a surface.

6. The apparatus of claim 1, wherein the housing comprises an adhesive that is configured to secure the apparatus to a surface.

* * * * *